United States Patent [19]

Cazzaro et al.

[11] 4,287,148

[45] Sep. 1, 1981

[54] PROCESS FOR PRODUCING GLOSSY FIBRES OF THE MODACRYLIC TYPE HAVING REDUCED INFLAMMABILITY

[75] Inventors: Giorgio Cazzaro, Saronno; Giancarlo Matera, Monza; Antonino Cavallaro, Cesano Maderno; Marina Zani, Saronno, all of Italy

[73] Assignee: Snia Viscosa, Milan, Italy

[21] Appl. No.: 143,100

[22] Filed: Apr. 23, 1980

Related U.S. Application Data

[62] Division of Ser. No. 847,746, Nov. 2, 1977, Pat. No. 4,223,108.

[30] Foreign Application Priority Data

Nov. 3, 1976 [IT] Italy ..... 28980 A/76
Sep. 28, 1977 [IT] Italy ..... 27997 A/77

[51] Int. Cl.[3] ..... C08L 33/20; C08L 41/00

[52] U.S. Cl. ..... 264/182; 525/197; 525/212

[58] Field of Search ..... 264/182; 525/197, 212

[56] References Cited

U.S. PATENT DOCUMENTS

| | | | |
|---|---|---|---|
| 2,949,437 | 8/1960 | Hobson | 260/898 |
| 3,256,252 | 6/1966 | Kruckenberg et al. | 260/79.3 |
| 3,288,888 | 11/1966 | Wiekowski | 260/898 |
| 3,963,790 | 6/1976 | Couchoud | 260/898 |
| 4,036,803 | 7/1977 | Kobashi et al. | 260/29.6 AN |
| 4,056,517 | 11/1977 | Albers et al. | 260/79.3 M |
| 4,101,621 | 7/1978 | Yamamoto et al. | 264/182 |

FOREIGN PATENT DOCUMENTS 1522706 8/1978 United Kingdom .

*Primary Examiner*—Carman J. Seccuro
*Attorney, Agent, or Firm*—Burgess, Ryan & Wayne

[57] ABSTRACT

Modacrylic fibres from acrylonitrile, vinylidene chloride, and a sulphonated comonomer, having reduced inflammability and high glossiness and dye yield are prepared by wet spinning a polyblend obtained by mixing two binary copolymers, the first from acrylonitrile and the sulphonated comonomer, and the second from acrylonitrile and vinylidene chloride. As the sulphonated comonomer, a significantly homopolymerizable monomer is used, viz. a monomer which homopolymerizes with a conversion of at least 30–40% by weight, in the presence of azobisisobutyronitrile catalyst, under given standard reaction conditions. Preferred sulphonated monomers are acid or salts of the acrylamidoalkanesulphonic series. The spinning dope is a polyblend solution in an organic solvent chosen among dimethylformamide, dimethylacetamide, and dimethylsulphoxide, mixed with water.

10 Claims, 8 Drawing Figures

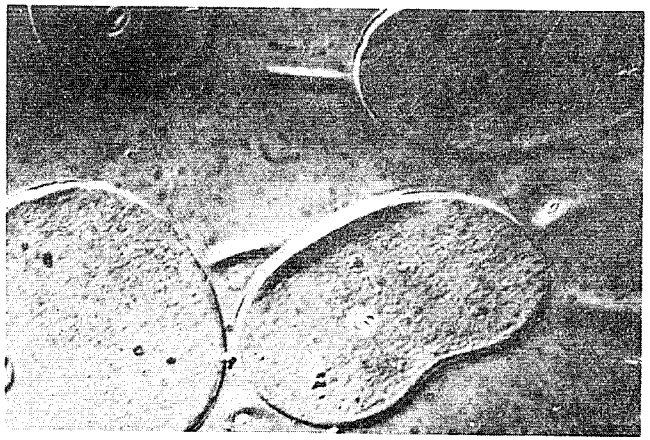
FIG. 1
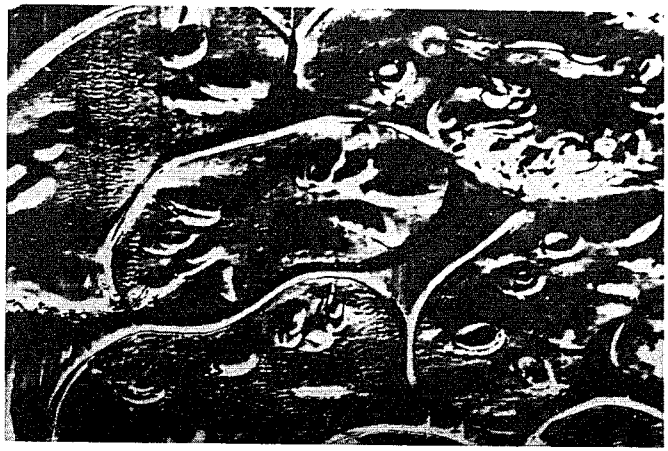
FIG. 2
FIG. 3
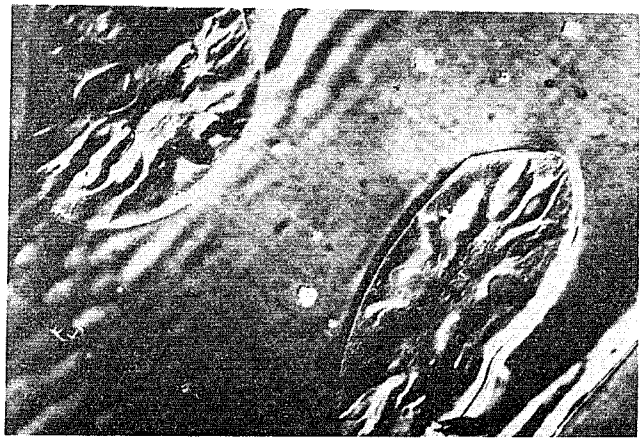

PROCESS FOR PRODUCING GLOSSY FIBRES OF THE MODACRYLIC TYPE HAVING REDUCED INFLAMMABILITY

This is a division, of application Ser. No. 847,746, filed Nov. 2, 1977, now U.S. Pat. No. 4,223,108.

BACKGROUND OF THE INVENTION (1) The Field of the Invention

The present invention relates to fibres of the modacrylic type which have a reduced inflammability but maintain a high degree of gloss even after the hydrothermal treatments such as boiling in water, dyeing, steaming. Further objects of the present invention are compositions and a process for making said modacrylic fibres by wet spinning solutions of polymers in dimethylformamide. "Modacrylic fibres" means fibres having a content of acrylonitrile (ACN) from 50 to 85% by weight.

(2) The Prior Art

In view of the pressing need, which has become felt in the latest years, of reducing the considerable inflammability of normal acrylic fibres, the manufacturers of these latter have endeavoured to obtain types of fibres having a reduced inflammability by using the same apparatus and the same process already used for the normal types, and have found an adequate solution of the problem in the use of certain monomers already employed for some time to produce the classic modacrylic fibres. The most suitable and easily available of all such monomers has been found to be vinylidene chloride.

Since a considerable amount of said comonomer is required in the copolymer to impart to the fibre a sufficient degree of resistance to the flame, its use produces an opacity of the product, especially when made by a wet spinning process wherein mixtures of water and dimethylformamide are employed as the coagulating bath. Consequently, the fibre does not possess the gloss and the dye yield required by the trade.

It is also known that the affinity for basic dyes of polyacrylonitrile based fibres may be substantially enhanced through the introduction of comonomers containing sulphonic groups, which further, in the case of wet spinning, improve the possibility of obtaining a glossy fibre. However it is impossible to obtain modacrylic fibres that are glossy when formed and maintain their glossiness after wet heat treatments, by a ternary copolymerization, viz. a copolymerization in which the sulphonic groups containing monomer and the vinylidene chloride are used concurrently with one another and with acrylonitrile, especially if enough vinylidene chloride is used to impart to the fibre produced, an antiflame quality corresponding to a LOI index not lower than 26% and if the coagulating bath consists of mixtures of water and DMF (dimethylformamide). The symbol "LOI", viz. Limiting Oxygen Index, indicates the minimum oxygen content in the air which is required to cause combustion of the product under the test conditions set forth in ASTM-D 2863-70. Products having a LOI value greater than or equal to 26 are to be considered as having a low inflammability.

There was therefore a true commercial need for low inflammability, modacrylic type fibres, concurrently maintaining:

(a) a good glossiness and consequently a good dye yield even after hydrothermal treatments;

(b) physico-textile characteristics as close as possible to those of the normal acrylic fibre, and for a process for their manufacture.

SUMMARY OF THE INVENTION

The applicants have now surprisingly found that, if the comonomer containing the sulphonic groups is not introduced through a normal process of ternary copolymerization of acrylonitrile/vinylidene chloride/sulphonated comonomer, but is introduced into the fibre in the same percentages by mixing in an appropriate ratio a binary copolymer ACN/sulphonated comonomer having a high content of this latter with a binary copolymer ACN/vinylidene chloride, it is possible to obtain a modacrylic type fibre which is much glossier and therefore has markedly higher dye yields than those obtained from the corresponding ternary copolymer having equal percentages of monomeric units of the three components, and this without changing the characteristics of uninflammability and the other physico-textile characteristics of the fibre.

The Applicants have also found that there exists an unforeseen and up to now unexplainable correlation between the capability of the sulphonated comonomer used to homopolymerize, and the glossiness and good dye yield of the fibre obtained.

The last mentioned properties are obtained whenever one uses a sulphonated monomer which will be termed "significantly homopolymerizable", by which expression is meant herein a sulphonated monomer which polymerizes, in the presence of $2.10^{-3}$ mols/lt of azobisisobutyronitrile (AIBN) at a concentration of $2.10^{-1}$ mols/lt in DMF containing 6 mols/lt of water, at a temperature of 67° C. for 11 hours, with a conversion to polymer not less than 30–40% by weight.

One class of such monomers is constituted by the acids of the acrylamidoalkanesulphonic series or their derivatives, such as the alkali or earth-alkali salts, or the salts of ammonium or of other amines, having the general formula

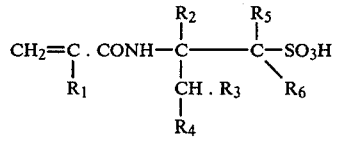

wherein $R_1$ is hydrogen or a short chain alkyl radical, while $R_2$-$R_3$-$R_4$-$R_5$ and $R_6$ are each hydrogen or an alkyl, cycloalkyl or aryl radical.

Specific examples of such sulphonated comonomers, which homopolymerize with conversions above 50% under the aforesaid conditions, are:

(1) 2-acrylamido-2-methylpropanesodium sulphonate, having the chemical formula:

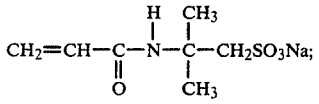

(2) 2-acrylamido-propanesulphonic acid, having the formula:

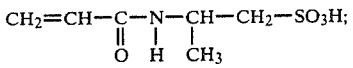

(3) 2-acrylamido-2-phenylethanesulphonic acid, having the formula:

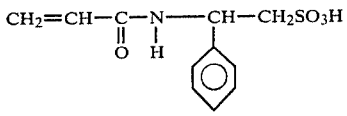

All significantly homopolymerizable sulphonated monomers, however, may be employed according to the invention, even if not belonging to the aforesaid series.

Therefore an object of this invention is constituted by modacrylic fibres having reduced inflammability and high glossiness, characterized in that they are constituted by a mixture of a binary copolymer A of acrylonitrile and a significantly homopolymerizable sulphonic monomer, as hereinbefore defined, with a binary copolymer B of acrylonitrile and vinylidene chloride.

More particularly, said fibres are characterized in that the binary copolymer A contains from 88% to 98% of monomeric units derived from acrylonitrile and from 2 to 12% of monomeric units derived from the said sulphonic comonomer, and the binary copolymer B contains from 55% to 88% of monomeric units derived from acrylonitrile and from 12% to 45% of monomeric units derived from vinylidene chloride, the fibre containing from 12% to 40% by weight of copolymer A and from 88% and 60% by weight of copolymer B.

Herein and hereinafter in this specification, percentages of monomeric units are given in mols and other percentages are by weight, always unless otherwise specified.

More preferably, the type A copolymer contains from 95 to 97% of monomeric units derived from ACN and from 3 to 5% of monomeric units derived from the sulphonated monomer, and the type B copolymer contains from 65 to 73% of monomeric units derived from ACN and from 27 to 35% of monomeric units derived from vinylidene chloride.

The fibres according to the invention are made by wet spinning a polyblend—by which word is meant in the art, an intimate and homogeneous mixture of different but mutually compatible polymers—obtained by mixing two solutions of a type A and a type B copolymer, respectively.

The content of the two copolymers in the polyblend is preferably comprised between 15 and 25% of copolymer A and between 85 and 75% of copolymer B.

The two binary copolymers, A and B, may of course be produced by any one of the known acrylonitrile copolymerization methods, viz. in aqueous emulsion or dispersion, in bulk, or in solution.

The preferred polyblend according to the invention comprises 20% of type A copolymer, containing about 96% of monomeric units derived from acrylonitrile and about 4% of monomeric units derived from the sulphonated monomer; and 80% of type B copolymer, containing about 70% of monomeric units derived from acrylonitrile and about 30% of monomeric units derived from vinylidene chloride.

A further object of this invention is a process for preparing a polyblend adapted for the preparation by wet spinning of reduced inflammability modacrylic type fibres, which maintain a stable glossiness even after the usual hydrothermal treatments.

Said process is characterized by the fact that the polyblend is obtained by the mechanical mixing, preferably at a temperature between 40° and 50° C., of a type A copolymer, as hereinbefore defined, with a type B copolymer, as hereinbefore defined, said type A and B copolymers being used in the amounts by weight hereinbefore specified. The order of the introduction of the components into the polyblend is not critical. This means that the solution of the copolymer A may be added to that of the copolymer B, or vice versa, or both solutions may be introduced concurrently.

It is also possible to obtain the polyblend by mixing in a suitable ratio the two polymeric solutions formed at the end of the polymerizations and containing the two binary copolymers A and B, before distilling off therefrom the unreacted monomers. This variant has the technological advantage that it is possible to use only one thin layer distillation apparatus, especially in a continuous process.

A further object of the invention are the polyblends prepared by the aforementioned process.

According to the present invention, dimethylsulphoxide and dimethylacetamide, besides DMF, may be used for preparing the polyblend solutions.

The viscous spinning dopes may contain, besides the polyblends according to the present invention, also other additives usually employed for this type of polymeric solutions, such as salts of calcium, barium, zinc, tin, etc., as stabilizers of polymer B, and products having sequestering properties for heavy metals, as stabilizers of polymer A.

DETAILED DESCRIPTION OF THE PREFERRED EMBODIMENTS

Figure 4:
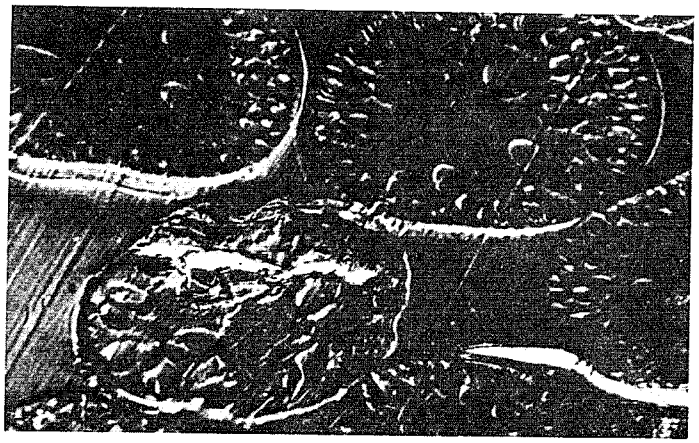

The spinning of the viscous solutions, which is effected in the wet according to the present invention, is carried out by methods known for this type of fibre.

Thus, e.g., it is possible to use a microspinning installation comprising only one spinneret with a low number of orifices according to the following specifications:

(A) Extrusion

To obtain the desired count of 3.3 dtex per filament in the final fibre, a spinneret having 175 orifices with a diameter of 65 microns is used.

(B) Spinneret feed

A gear micropump delivering 0.6 cc per revolution is used, the number of revolutions thereof being controlled so as to feed to the spinneret such an amount of polymeric solution drawn from a 2 liters storage vessel kept at 40°-50° C., as to produce the required final count per filament. Since the required count is 3.3 dtex for all examples and the concentration of solids in the solutions employed to make the modacrylic fibre is the same for all examples, and precisely 22.5%, the number of revolutions is never changed.

(C) Coagulation

The coagulation is effected in a 1 meter long tub containing a bath maintained at 12°-13° C. with constant water content of 60% and DMF content of 40%.

(D) Take-up

From the coagulation tub, the yarn is taken up by means of a roller/pin device at the speed of 10 meters per minute.

(E) Washing

From the coagulation tub the yarn passes through a series of troughs where it is washed with demineralized water kept at 50° C., in countercurrent, until the residual DMF is less than 0.5% calculated on the dry yarn.

(F) Drawing

From the wash troughs, the yarn is passed through a drawing tub having the same size as the coagulation tub, which contains demineralized water kept at 98°-100° C., where it undergoes a drawing in a ratio of 5.5 (5.5X), and from which it is taken up with another roller/pin device, at a speed of 55 meters per minute; after drawing, the yarn passes through a finishing trough where lubricating and antistatic products, known for this purpose, are applied thereto.

(G) Drying

After the application of the finish, the yarn enters into a ribbon dryer which permits the yarn to retract freely (by about 20%) during the drying in air.

The fibre thus obtained is ready to be submitted to the controls specified for this case, viz.:

(a) The cross-section of the filament after coagulation is microphotographed;

(b) The dye yield in the final dry fibre is checked, so as to establish the amount of dye required to obtain in the fibres obtained according to the various examples, the same shade of colour obtained in a preferred fibre, according to the present invention, assumed as the basis of the comparison, when it is dyed with a given amount of dye. As preferred, comparison fibre, that of Example 1, has been chosen, and the shade of colour to be obtained in all cases is that which the fibre assumes when dyed with 2 grams of dye per 100 grams of dry fibre. The colour chosen for this control, is a dark brown hue obtained by using the following three dyes mixed in the follosing proportions:

| | | |
|---|---|---|
| (1) | MAXILON 2RL YELLOW | = 50% |
| (2) | MAXILON GRL RED | = 24% |
| (3) | MAXILON GRL BLUE | = 26% |

The shade of colour obtained, e.g. in the fibre of Example 1, has been obtained by dyeing, by conventional procedures, until the dye has been exhausted, 5 grams of fibre in 200 cc of an aqueous solution containing 0.1 grams of a mixture of said dyes. Therefore only the number corresponding to the grams of dye used up by 100 grams of the fibre under examination, will be indicated under item (b) of the control data. It is obvious that the higher this number, the higher is the opacity of the fibre.

(c) LOI index;

(d) determination of the degree of porosity of the fibre in the state of gel, evaluated by measuring, by known methods, the surface area expressed as square meters per gram of fibre. The greater said area value, the finer the porosity of the fibre and therefore the higher its glossiness.

(e) Dynamometric characteristics of the final fibre.

Control items (a), (b) and (c) are those which establish the differences in the degree of glossiness between the various samples.

A further object of the present invention is to provide modacrylic fibres having reduced inflammability which maintain a stable gloss when subjected to hydrothermal treatments, obtained from a polyblend which contains a type A binary copolymer and a type B binary copolymer having the aforesaid compositions, in the amounts indicated.

The invention will be better illustrated by the description of a number of non-limitative examples, with reference to the appended drawings, which are all microphotographs of the cross-section of the filaments after coagulation: FIGS. 1 to 8 illustrating each the cross-section of the filaments obtained according to the example which has the same number as the figure.

In the examples, the type A and B binary copolymers, according to the present invention, as well as the ternary copolymers having the same overall compositions as the said A and B copolymers, are obtained by batch polymerization in 5 liters glass laboratory reactors suitably equipped for this purpose, the polymerization being carried out in a solvent in homogeneous phase; the respective fibres being obtained as hereinbefore described, using as the coagulating bath, solvent/$H_2O$ mixtures, and producing a count of about 3.3 dtex per filament in all cases. In the first six examples, the significantly homopolymerizable sulphonic comonomers is 2-acrylamido-2-methylpropanesodium sulphonate, also designated by the word "SAMPS", hereinbefore mentioned.

EXAMPLE 1

In this example the conditions are described for obtaining two A and B binary copolymers which, contained in a ratio of 20 parts by weight of A and 80 parts by weight of B, furnish a flame resistant fibre, which is very glossy and free of cavities and affords excellent dye yields.

This example embodies the most preferred conditions for achieving the object of the present invention. Said conditions are as follows:

(A) Polymerization conditions for obtaining the two type A and B copolymers.

| | | |
|---|---|---|
| (a) Composition of the polymerization mixture (by weight): | | |
| Copolymer type | A | B |
| ACN, % | 27.20 | 24.75 |
| SAMPS, % | 4.80 | — |
| $CH_2{=}CCl_2$, % | — | 20.25 |
| $H_2O$, % | 2.00 | 6.00 |
| DMF, % | 66.00 | 49.00 |
| Total monomers in mixture, % | 32.00 | 45.00 |
| (b) Percentages by weight of the comonomers in the respective polymerization mixtures: | | |
| Copolymer type | A | B |
| ACN, % | 85.00 | 55.00 |
| $CH_2{=}CCl_2$, % | 0.0 | 45.0 |
| SAMPS, % | 15.00 | — |
| (c) Polymerization conditions: | | |
| Copolymer type | A | B |
| temperature °C. | 67° | 52° |
| duration, hours | 11 | 13 |
| AIBN catalyst (azobisisobutyronitrile), % | 0.027 | 0.2 |
| malic acid stabilizer, % | 0.015 | — |
| paratoluene zinc sulphonate stabilizer, % | — | 0.1 |
| (d) Characteristics of the mixture obtained at the end of the polymerization: | | |
| Copolymer type | A | B |
| solids, % | 21.0 | 19.1 |
| monomers conversion to polymer, % | 65.6 | 42.4 |
| conversion of SAMPS to polymer, % | 65.6 | — |
| (e) Composition and molecular weight of the polymers: | | |
| Copolymer type | A | B |
| ACN, % by weight | 85.00 | 55.00 |
| in mols | 96.07 | 69.09 |

-continued

| | | |
|---|---|---|
| SAMPS, % by weight | 15.00 | — |
| in mols | 3.93 | — |
| $CH{=}CCl_2$, % by weight | — | 45.00 |
| in mols | — | 30.91 |
| (f) Characteristics of the viscous spinning dopes: | | |
| solids, % | 22.5 | 22.5 |
| DMF, % | 77.5 | 77.5 |

The final viscous spinning solution is obtained by mixing 20 parts of the solution of polymer A and 80 parts of the solution of polymer B in one of the known static or dynamic mixers used for high viscosity polymeric solutions.

The fibre obtained by spinning said solution has the same composition by weight and by monomeric units as that obtained from the ternary copolymer of Example 5, viz.:

| | | |
|---|---|---|
| ACN | 61% by weight | 74.96 by mols |
| $CH_2{=}CCl_2$ | 36% by weight | 24.19 by mols |
| SAMPS | 3% by weight | 0.85 by mols |

(B) Control Data:

| | |
|---|---|
| a: see FIG. 1 | |
| b = 2 grams of dye | |
| c = 26% $O_2$ | |
| d = 75 $m^2/g$ | |
| e = count, dtex | 3.2 |
| tenacity, g/dtex | 2.7 |
| elongation, % | 33.5 |
| loop tenacity, g/dtex | 1.3 |
| residual retraction in water at 100° C., % | 0.4 |

The control data show the considerable degree of glossiness with respect to the fibre obtained from a dope having the same composition as in Example 5 (comparison example).

In Example 2, will be demonstrated how a fibre having a degree of glossiness still higher than that of the ternary copolymer of control Example 5 is obtained from a polyblend according to the invention, even when the amount of sulphonated monomer in the final fibre is decreased to a given extent.

The percentage of SAMPS is lowered, in the example, by decreasing the amount of type A binary copolymer to be mixed with the type B copolymer; of course, the composition of this latter too is changed by decreasing the percentage of $CH_2{=}CCl_2$ to such an extent that the final fibre will still contain 36% of it.

EXAMPLE 2

In this example the control data are tabulated relative to a final fibre containing 15 parts by weight of a copolymer A having the same composition as that described in Example 1 and 85% parts by weight of a copolymer B containing 71.21% of monomeric units derived from acrylonitrile and 28.79% of monomeric units derived from vinylidene chloride. The conditions for the preparation of copolymers A and B are the same as in Example 1, but may be varied in a manner known to persons skilled in the art.

| Control Data: | |
|---|---|
| a: see FIG. 2 | |
| b = 3.5 grams of dye | |
| c = 26% $O_2$ | |
| d = 56 $m^2/g$ | |
| e = count, dtex | 3.3 |
| tenacity, g/dtex | 2.6 |
| elongation, % | 32 |
| loop tenacity, g/dtex | 1.3 |
| residual retraction in water at 100° C., % | 0.6 |

From the above control data, it is seen that when a polyblend is used, a decrease of the SAMPS content down to 2.25% permits to obtain a fibre having glossiness characteristics still clearly superior to those of the fibre of Example 5.

EXAMPLE 3

In this example the control data are tabulated relative to a fibre obtained by mixing 12 parts by weight of binary copolymer A, containing 7.16% of monomeric units derived from SAMPS and 92.84% of monomeric units derived from ACN, with 88 parts by weight of binary copolymer B containing 72.46% of monomeric units derived from ACN and 27.54% of monomeric units derived from vinylidene chloride.

| Control Data: | |
|---|---|
| a: see FIG. 3 | |
| b = 3 g of dye | |
| c = 26% $O_2$ | |
| d = 58 $m^2/g$ | |
| e = count, dtex | 3.1 |
| tenacity, g/dtex | 2.6 |
| elongation, % | 30 |
| loop tenacity, g/dtex | 1.2 |
| residual retraction in water at 100° C., % | 0.6 |

The above data evidence that the fibre has glossiness characteristics clearly better than that of Example 5 but worse than that of Example 1.

EXAMPLE 4

In this example the control data are tabulated relative to a final fibre still containing 0.9% of monomeric units derived from SAMPS, 31.84% of monomeric units derived from vinylidene chloride, and 67.26% of monomeric units derived from acrylonitrile.

Said fibre is prepared from a viscous solution constituted by a polyblend obtained by mixing 20 parts by weight of a copolymer A having the same composition as in Example 1, with 80 parts by weight of a copolymer B containing 41.29% of monomeric units derived from vinylidene chloride and 58.71% of monomeric units derived from acrylonitrile.

This example has the purpose of demonstrating that when the percentage of $CH_2{=}CCl_2$ in the final fibre is increased up to about 32% in terms of monomeric units, a fibre is obtained that is still glossier than that of Example 5.

| Control Data: |
|---|
| a: see FIG. 4 |
| b = 2.6 g of dye |
| c = 29% $O_2$ |
| d = 60 $m^2/g$ |

-continued

| Control Data: | |
|---|---|
| e = count, dtex | 3.2 |
| tenacity, g/dtex | 2.0 |
| elongation, % | 36 |
| loop tenacity, g/dtex | 1 |
| residual retraction in water at 100° C., % | 1.45 |

EXAMPLE 5

In this example, which is not an illustration of the invention, but is a comparison example, there are set forth, for purposes of comparison, the conditions relative to the production of a ternary copolymer containing: 0.85% of monomeric units derived from SAMPS, 24.19% of monomeric units derived from $CH_2{=}CCl_2$ and 74.96% of monomeric units derived from ACN. The characteristics and the control data relative to the fibre thus obtained, which is opaque and has a low dye yield, are as follows:

(A) Polymerization conditions

| | | |
|---|---|---|
| (a) Composition of the polymerization mixture: | | |
| ACN, % | | 27.81 |
| $CH_2{=}CCl_2$, % | | 16.20 |
| SAMPS, % | | 0.99 |
| $H_2O$, % | | 3.00 |
| DMF, % | | 52.00 |
| Total monomers, % | | 45.00 |
| (b) Percentages by weight of the three comonomers in the polymerization mixture: | | |
| ACN, % | | 61.80 |
| $CH_2{=}CCl_2$, % | | 36.00 |
| SAMPS, % | | 2.20 |
| (c) Polymerization conditions: | | |
| temperature, °C. | | 52° |
| duration, hours | | 13 |
| AIBN catalyst, % | | 0.2 |
| stabilizer, % | | 0.1 |
| (d) Characteristics of the mixture obtained at the end of the polymerization: | | |
| Polymer content, % | | 20.30 |
| Monomer conversion to polymer, % | | 45.00 |
| SAMPS conversion to polymer, % | | 61.50 |
| (e) Composition and characteristics of the polymer obtained: | | |
| ACN | 61% by weight | 74.96% by mols |
| $CH_2{=}CCl_2$ | 36% by weight | 24.19% by mols |
| SAMPS | 3% by weight | 0.85% by mols |
| (f) Characteristics of the viscous spinning solution obtained after recovering the unreacted monomers by vacuum distillation: | | |
| solids, % | | 22.5 |
| DMF, % | | 77.5 |
| storage temperature, °C. | | 40° |

The spinning conditions are as set forth hereinbefore.

(B) Control Data

Figure 5:
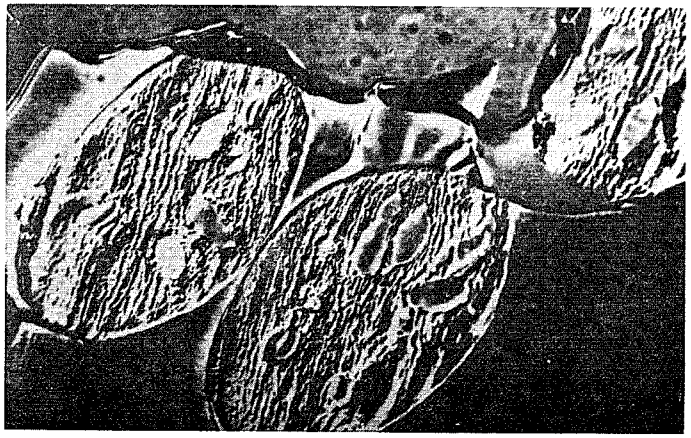

| | |
|---|---|
| a: see FIG. 5 | |
| b = 6 g of dye | |
| c = 26% $O_2$ | |
| d = 35 $m^2/g$ | |
| e = count, dtex | 3.3 |
| tenacity, g/dtex | 2.4 |
| elongation, % | 30.4 |
| loop tenacity, g/dtex | 1.2 |
| residual retraction in water at 100° C., % | 0.5 |

The control data clearly evidence the opacity of the fibre, both because of the presence of cavities shown in FIG. 5, and because of the greater consumption of dye (6 g) compared to the fibre of Example 1 (2 g) and of the low value of the fibre surface area (35 $m^2/g$).

EXAMPLE 6

This example describes the operative conditions and the characteristics of a fibre obtained by mixing the two polymeric solutions obtained at the end of the polymerizations of Example 1.

After mixing them, the unreacted volatile monomers are eliminated by vaccum distillation and the polyblend is obtained, which is constituted by a 22.5% by weight solution of a polymeric material constituted by 61% by weight of acrylonitrile, 36% by weight of vinylidene chloride, and 3% by weight of 2-acrylamido-2-methylpropanesodium sulphonate, corresponding to about 131 sulphonic milliequivalents (meq) per kg of polymer.

Figure 6:
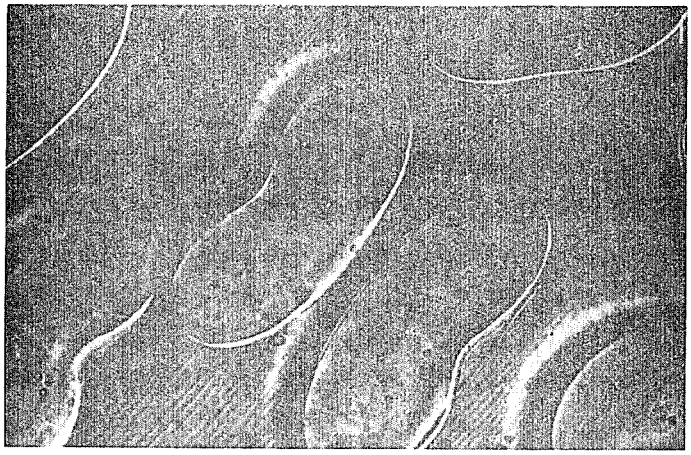

By spinning said solution under the conditions of the foregoing examples, a fibre is obtained which has the following control data:

| | |
|---|---|
| a: see FIG. 6 | |
| b = 2.1 g of dye | |
| c = 26% $O_2$ | |
| d = 75 $m^2/g$ | |
| e = count, dtex | 3.1 |
| tenacity, g/dtex | 2.65 |
| elongation, % | 32.8 |
| loop tenacity, g/dtex | 1.25 |

The control data show the ammost perfect identity of characteristics with respect to the fibre of Example 1 and prove that mixing the two solutions before distillation does not affect the characteristics of the fibre.

EXAMPLE 7

This example sets forth the operative conditions and the characteristics of a fibre obtained by using, for the production of the binary copolymer A of acrylonitrile and sulphonic comonomer, 2-acrylamido-propanesulphonic acid instead of the 2-acrylamido-methylpropanesodium sulphonate used in Examples 1 to 6, whereby a fibre is obtained which is quite similar as to glossiness and dye yield to that of Example 6. To render the comparison valid, the acrylonitrile/sulphonate binary copolymer is prepared in such a way that the number of acid milliequivalents per kg of polymer is about equal to that of Example 6, viz. is about 650.

Said copolymer is obtained by polymerizing at 67° C., for 11 hours, 27.9 parts by weight of acrylonitrile and 4.10 parts by weight of 2-acrylamido-propanesulphonic acid in 2 parts by weight of water and 66 parts by weight of DMF in the presence of 0.027 parts by weight of AIBN and 0.015 parts by weight of malic acid stabilizer. At the end of the polymerization, the mixture contains 20% of a copolymer containing 87.0% by weight of acrylonitrile and 13.0% by weight of 2-acrylamido-propanesulphonic acid, corresponding to about 660 milliequivalents per kg of polymer. 20 parts by weight of said end polymerization mixture relative to the first binary acrylonitrile/sulphonate copolymer A are mixed with 84 parts by weight of the end polymerization mixture relative to the acrylonitrile/vinylidene chloride binary copolymer used in Example 1 and containing 19.1% by weight of a copolymer constituted by 55% by weight of acrylonitrile and 45% by weight of vinylidene chloride.

After mixing, the unreacted volatile monomers are eliminated by vacuum distillation and the polyblend is obtained, which is constituted by 22.5% a solution of a polymer containing 61.40 by weight of acrylonitrile and 36% by weight of vinylidene chloride and 2.6% by weight of 2-acrylamido-propanesulphonic acid, corresponding to about 130 acid milliequivalents.

Figure 7:
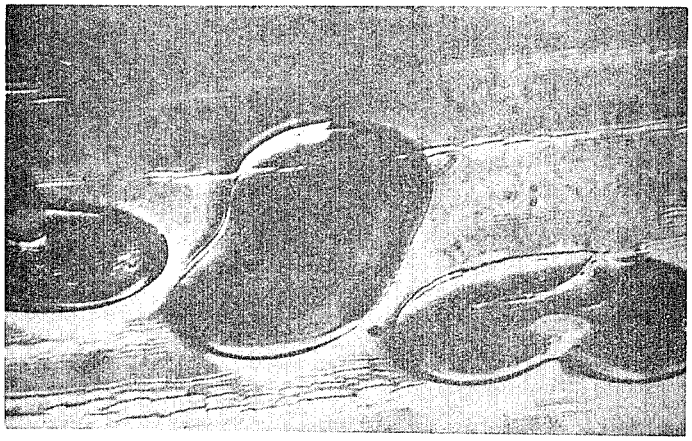

By spinning said solution under the same conditions as in Example 6, a fibre is obtained which has the following control data:

| | |
|---|---|
| a: see FIG. 7 | |
| b = 2 g of dye | |
| c = 26% $O_2$ | |
| d = 77 $m^2/g$ | |
| e = count, dtex per filament | 3.2 |
| tenacity g/dtex | 3.58 |
| elongation, % | 33.2 |
| loop tenacity, g/dtex | 1.23 |

The control data show that there is practically no difference from those of Example 6.

EXAMPLE 8

This example sets forth the operative conditions and the control data relative to a fibre obtained by using as a sulphonic comonomer, for the production of the acrylonitrile/sulphonate binary copolymer A, 2-acrylamido-2-phenylethanesulphonic acid, which acid provides a fibre that is quite similar as to glossiness and dye yields to those of the foregoing examples.

In this case too the acrylonitrile/sulphonate binary copolymer A is produced in such a way that the content of acid milliequivalents per kg of polymer is approximately equal to those of the foregoing examples, viz. about 650.

Said copolymer is obtained by polymerizing at 67° C. for 11 hours, 27.00 parts by weight of acrylonitrile and 5.00 parts by weight of 2-acrylamido-2-phenylethanesulphonic acid in 2 parts by weight of water and 66 parts by weight of DMF in the presence of 0.027 parts by weight of AIBN and 0.015 parts by weight of malic acid stabilizer. At the end of the polymerization, the mixture contains 20% by weight of a copolymer containing 83.3% by weight of acrylonitrile and 16.7% by weight of 2-acrylamido-2-phenylethanesulphonic acid, corresponding to a content of about 655 acid meq per kg of polymer.

20 parts by weight of said end polymerization mixture are mixed with 84 parts by weight of the end polymerization mixture relative to the acrylonitrile/vinylidene chloride binary copolymer used in the foregoing examples, viz. containing 19.1% by weight of a B copolymer consisting of 55% by weight of acrylonitrile and 45% by weight of vinylidene chloride.

After mixing, the unreacted volatile monomers are eliminated by vacuum distillation and a 22.5% solution of a polymeric material is obtained which is composed of 60.66% by weight of acrylonitrile, 36% by weight of vinylidene chloride, and 3.34% by weight of 2-acrylamido-2-phenylethanesulphonic acid, corresponding to about 130 acid meq per kg of polymer.

Figure 8:
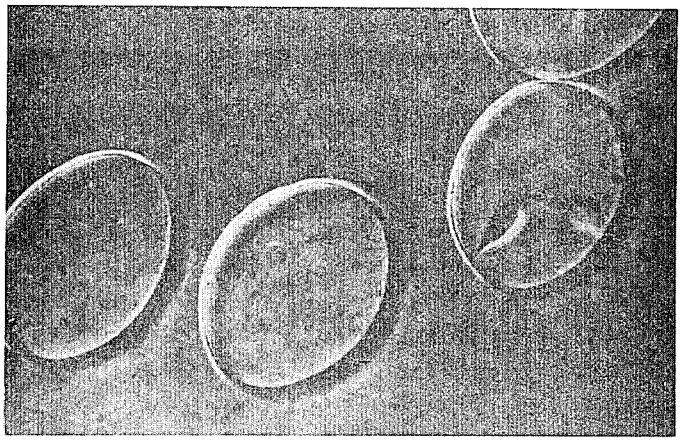

By spinning said solution under the same conditions as in the foregoing examples, a fibre is obtained which has the following control data:

| | |
|---|---|
| a: see FIG. 8 | |
| b = 2.1 g of dye | |
| c = 26% $O_2$ | |
| d = 78 $m^2/g$ | |
| e = count, dtex per filament | 2.98 |
| tenacity, g/dtex | 2.63 |
| elongation, % | 31.9 |
| loop tenacity, g/dtex | 1.28 |

In this case too, the control data show that there is practically no difference between the fibres of the foregoing examples, according to the invention, and that of this example.

We claim:

1. A process for preparation of the modacrylic fibres having reduced inflammability and high glossiness which comprises preparing a viscous solution of a mixture of a binary copolymer A containing from 88% to 98% of monomeric units derived from acrylonitrile and from 2 to 12% of monomeric units derived from a significantly homopolymerizable sulphonic acid monomer of the formula

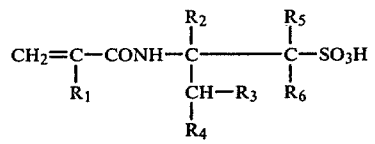

and salts of said acid, wherein R is hydrogen or a short chain alkyl radical and $R_2$, $R_3$, $R_4$, $R_5$, and $R_6$ are each hydrogen or an alkyl, cyloalkyl or aryl radical, and a binary copolymer B containing from 55% to 88% of monomeric units derived from acrylonitrile and from 12% to 45% of monomeric units derived from vinylidene chloride in a spinning solvent, and spinning said viscous solution to form fibres containing from 12% to 40% by weight of copolymer A and 88% to 60% by weight of copolymer B.

2. A process for the preparation of modacrylic fibres having reduced inflammability and high glossiness of claim 1, which comprises preparing a polyblend containing binary copolymer A and binary copolymer B, preparing a viscous spinning dope consisting of a solution of said polyblend in a mixture of water and a solvent selected from the group consisting of dimethylformamide, dimethylacetamide, and dimethylsulphoxide, and wet spinning the dope.

3. Process according to claim 2, comprising of spinning the dope in a coagulating bath containing water and the solvent of the spinning dope.

4. Process according to claim 3, wherein the solvent of the spinning dope is dimethylformamide and the coagulating bath contains about 40% by weight of dimethylformamide and about 60% by weight of water.

5. A process according to claim 1, wherein the viscous solution is wet spun in a coagulating bath.

6. A process according to claim 1, wherein the viscous solution is prepared by mixing a first solution containing the binary copolymer A in a spinning solvent with a second solution containing the binary copolymer B in the same solvent, the first solution containing the binary copolymer A in an amount from 12 to 40% by weight and the second solution containing the binary copolymer B in an amount from 88 to 60% by weight, with respect to the total weight of the two copolymers.

7. A process according to claim 6, wherein the two solutions are mixed at a temperature from 40° to 50° C.

8. A process according to claim 1 wherein copolymer A contains from 95 to 97% of monomeric units derived from acrylonitrile and from 3% to 5% of monomeric units derived from the sulphonic comonomer, and the copolymer B contains from 65 to 73% of monomeric units derived from acrylonitrile and from 27 to 35% of monomeric units derived from vinylidene chloride, the fibre containing from 15 to 25% by weight of copolymer A and from 85 to 75% by weight of copolymer B.

9. A process according to claim 1 wherein copolymer A contains about 96% of monomeric units derived from acrylonitrile and about 4% of monomeric units derived from the sulphonic comonomer and copolymer B contains about 75% of the monomeric units derived from acrylonitrile and about 30% of the monomeric units derived from vinylidene chloride, the fibre containing about 20% by weight of copolymer A and about 80% by weight of copolymer B.

10. A process according to claim 1 wherein the binary copolymers A and B are separately prepared by polymerization to form two polymer solutions and the polyblend is prepared by mixing the two solutions obtained at the end of the polymerization in the desired ratio, and removing the unreacted volatile monomers by distillation.

* * * * *